United States Patent [19]

Speer

[11] 4,365,442

[45] Dec. 28, 1982

[54] AUTOMATIC DOOR CONTROL SYSTEM

[76] Inventor: Harold A. Speer, 718 Front St., San Diego, Calif. 92101

[21] Appl. No.: 190,477

[22] Filed: Sep. 24, 1980

Related U.S. Application Data

[63] Continuation-in-part of Ser. No. 58,153, Jul. 17, 1979, abandoned.

[51] Int. Cl.[3] ..... E05F 11/24

[52] U.S. Cl. ..... 49/346; 49/30; 49/344

[58] Field of Search ..... 49/29, 30, 139, 273, 49/274, 340, 345, 346, 344

[56] References Cited

U.S. PATENT DOCUMENTS

| | | | |
|---|---|---|---|
| 2,758,835 | 8/1956 | Wikkerink | 49/30 |
| 2,900,791 | 8/1959 | Kinsey | 49/30 X |
| 3,136,537 | 6/1964 | Whitfield | 49/340 |
| 3,874,117 | 4/1975 | Boehm | 49/30 X |

*Primary Examiner*—Kenneth Downey

*Attorney, Agent, or Firm*—Brown & Martin

[57] ABSTRACT

An automatic door operating system includes a gas operated linear motor connected to operate a door by means of a unidirectional linkage system including an arm for unidirectional engagement of the door and a control system including a source of compressed gas for selectively opening the door and for controlling the duration of the door open position. The control system includes a variable timing release for variable timing of the duration of the valve opening. The actuator for the system can be remotely positioned for maintaining the door in open position for sufficient duration to permit passing therethrough. The linkage system permits the door to be manually operated totally independent of the operating system.

14 Claims, 9 Drawing Figures

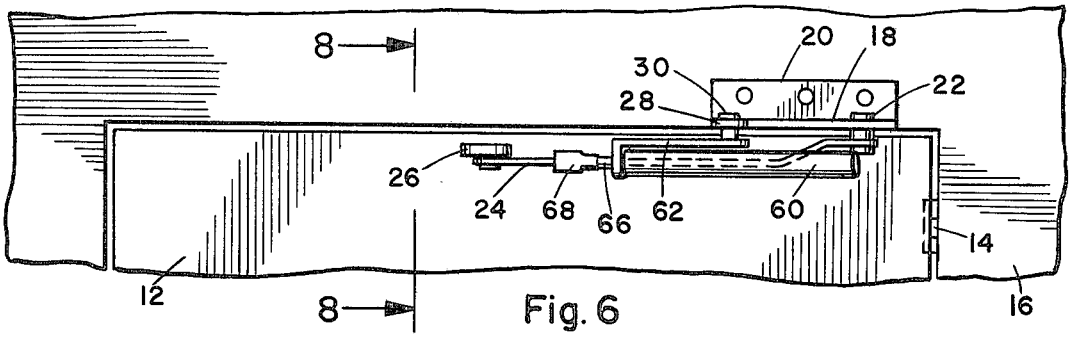
Fig. 6
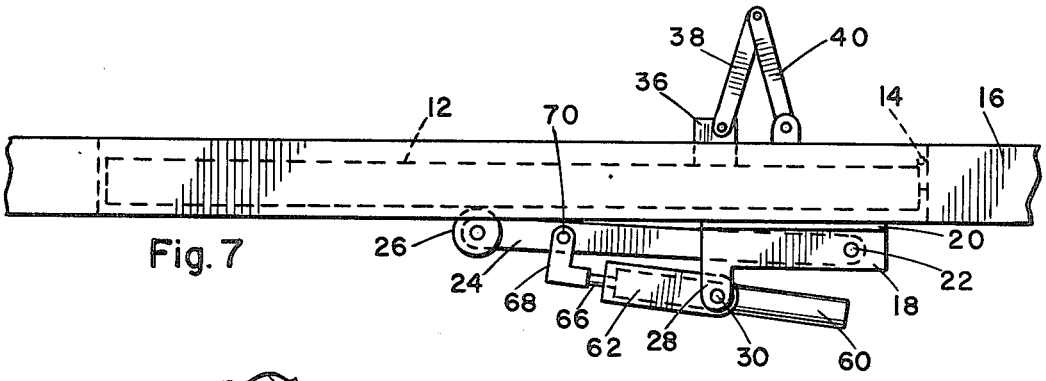
Fig. 7
Fig. 8
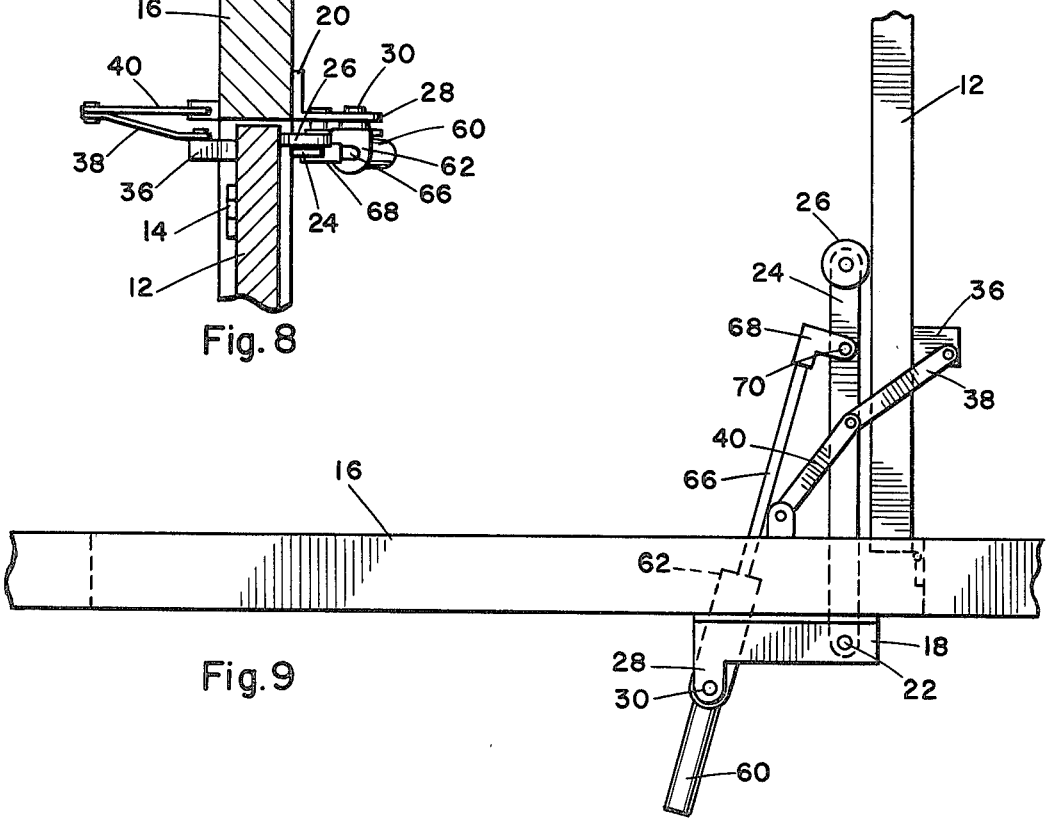
Fig. 9

AUTOMATIC DOOR CONTROL SYSTEM

REFERENCE TO RELATED APPLICATION

This application is a continuation-in-part of my copending application Ser. No. 58,153, Filed: July 17, 1979 entitled "Automatic Door Control System", now abandoned.

BACKGROUND OF THE INVENTION

The present invention relates to door control systems and pertains particularly to a power system for opening doors.

Much attention has been directed in recent years to the development of doors which can be easily used by the handicapped. Such doors generally should be remotely operated or powered opened to permit the quick and easy passage therethrough, of persons in wheelchairs and the like. Most of such doors in use today are hydraulically or electro-mechanically actuated.

The electro-mechanically actuated system involves a very complicated control system and are typically very sensitive to adjustment to prevent injury to persons in traffic passage through the door. Such systems are also extremely expensive and usually subject to frequent failure.

Hydraulic systems are also expensive and require complicated control systems. Such hydraulic systems are also subject to leakage and involve the use of an undue amount of plumbing. Such systems are also expensive, requiring special construction and space requirements.

It is therefore desirable that some system for opening doors be available that avoids these problems of the prior art.

SUMMARY AND OBJECTS OF THE INVENTION

It is the primary object of the invention to provide an improved door opening system that is simple and economical and permits manual opening of the door.

In accordance with the primary aspect of the present invention a door opening mechanism includes a source of pressurized gas with a gas operated motor for opening the door by means of a unidirectional linkage which is effective upon actuation of the system for pushing the door to the open position and including timer means for controlling the duration of the open state of the door.

BRIEF DESCRIPTION OF THE DRAWING

The above and other objects and advantages of the present invention will become apparent from the following description when read in conjunction with the drawings, wherein:

FIG. 6 is a view like FIG. 1 of an alternate embodiment.

FIG. 7 is a view like FIG. 2 of the FIG. 6 embodiment.

FIG. 8 is a view like FIG. 3 of the FIG. 6 embodiment.

FIG. 9 is a view like FIG. 4 of the FIG. 6 embodiment.

DETAILED DESCRIPTION OF THE PREFERRED EMBODMENT

Figure 1:
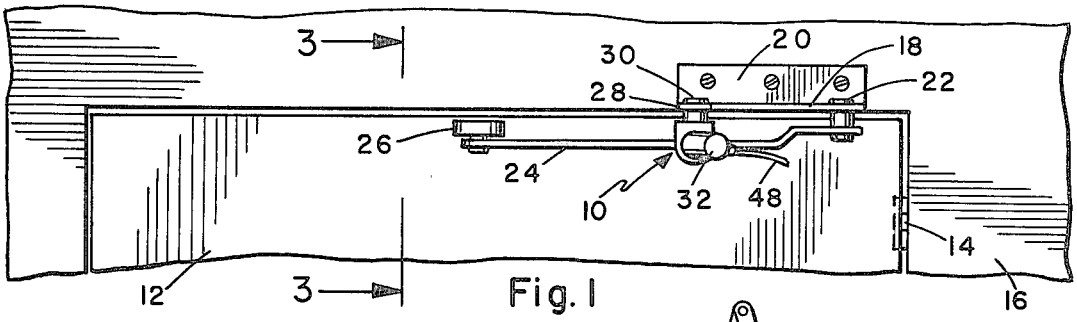
FIG. 1 is a side elevation view of the door opening mechanism attached to a typical door.
Figure 2:
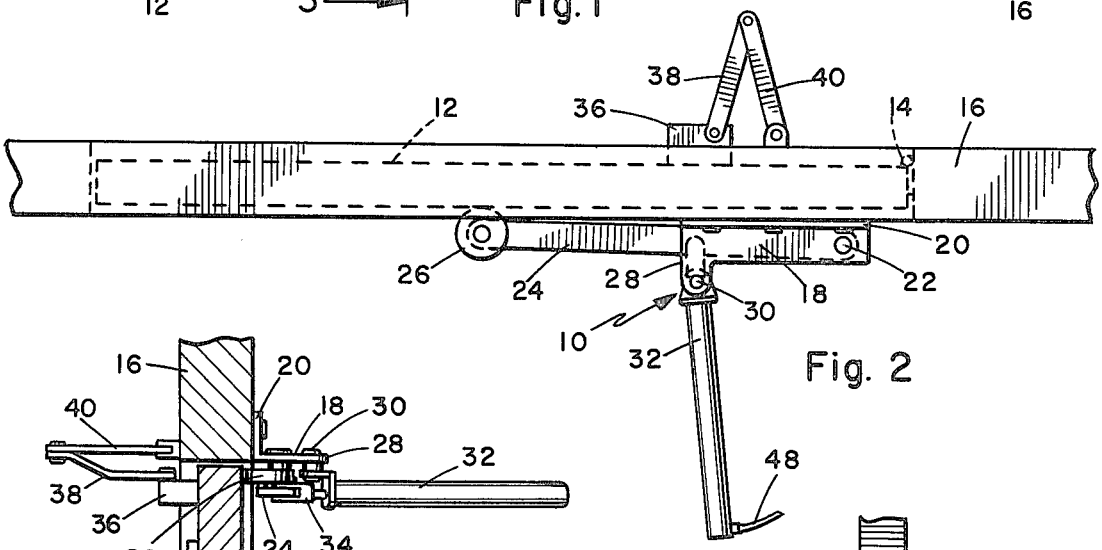
FIG. 2 is a top plan view of the installation with the door closed.
Figure 3:
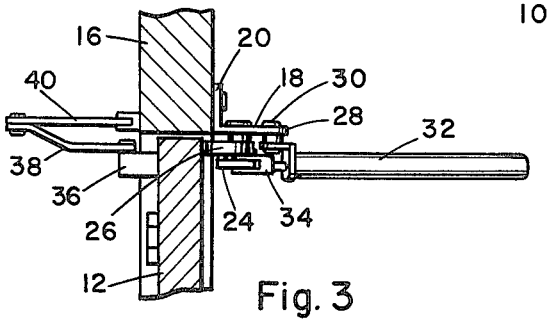
FIG. 3 is a sectional view taken on line 3—3 of FIG. 1.

Turning now to the drawings, there is illustrated a door opening mechanism in accordance with the present invention designated generally by the numeral 10. This door opening mechanism as illustrated is attached in position for opening a conventional door 12 which is hinged at or by suitable hinged means 14 to a door frame 16 of conventional design. The door is illustrated as a conventional door swinging about the vertical axis of its hinge 14 between closed positions as shown in FIG. 2 and an open position shown in FIG. 4.

The mechanism 10 of the present invention comprises a base support member or bracket having a generally horizontal bracket portion 18 and having an upper plate or portion 20 secured to the wall or door facing 16 above the door. The horizontally extending portion 18 of the bracket includes a first pivot means or pin 22 for pivoting a push arm 24 about the pin axis. The push arm 24 includes a roller 26 which engages the face of the door 12 at the upper edge thereof for pushing the door to the open position. The roller may simply engage the door or be adapted to engage a track as desired. The arm 24 pivots about the axis 22 which is parallel to the pivot axis of the door. The bracket 18 includes a further support arm 28 extending outward from which is pivoted a fluid cylinder 32 by means of a pivot pin 30. The cylinder 32 is a linear motor having its rod end 34 connected to the push arm 24.

Figure 4:
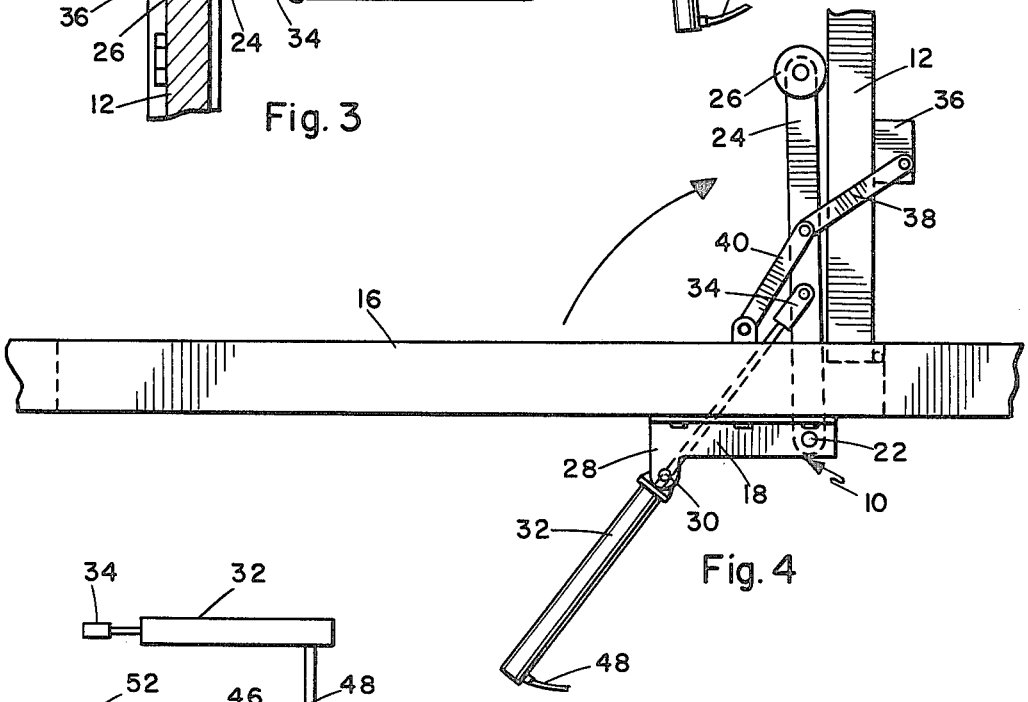
FIG. 4 is a top plan view of the installation with the door open.
Figure 5:
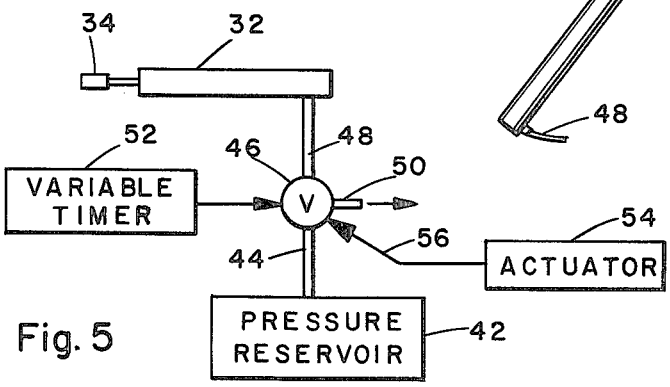
FIG. 5 is a diagram of the actuating system.

The motor 32 is preferably gas operated, such as by compressed air or the like, and upon operaton extends the piston thereof outward, forcing arm 24 about its axis for unidirectional engagement and opening the door 12 as shown in FIG. 4.

A single acting motor 32 is effective in the present system since the mechanism functions only to push the door to the open position. Preferably an air cylinder is utilized in the system to simplify the system and enhance the safety thereof. By this system sufficient pressure can be utilized to push the door to the open position yet avoid any injury to persons passing through the door. The pressure forcing the door open can be controlled, either by the pressure of the fluid acting within the motor or the combination of the pressure and the size of the piston within the motor itself. With this system, small economical cylinders can be utilized in the systems.

The door is closed by means of a conventional door closer 36 of the type which is generally available off the shelf from hardware stores and the like. One suitable closer, for example, is the Reading Model 603 from the Reading Co., Reamstown, Pa. The closer includes a piston and cylinder arrangement with a spring for biasing the door into a closed position with fluid for dampening the movement of the door. The closer device 36 is mounted on the door or frame and includes an arm 38 connected to the internal mechanisms such as a spring and piston within the body member 36, and by means of a link 40 to the door or the door frame. With this arrangement the opening mechanism in accordance with the invention is utilized in combination with a conventional door closer such that the opener opens the doors and, upon releasing the door for closing, the closer operates to close the door in a conventional fashion. The door can be operated in the conventional manner without interference from the opener.

The door opening mechanism of the present invention can be utilized in conjunction with any number of simplified controls systems. In accordance with the invention, a simple source of pressurized fluid such as compressed air or gas is available from a pressure reservoir 42 and supplies pressurized gas by means of a suitable line 44 to a control valve 46. The control valve 46 is operative to direct the pressurized gas by way of a line 48 to the cylinder 32 for actuation of the cylinder. The valve 46 is operated to an open position for directing gas to the cylinder 32 or to a closed position for venting the cylinder by way of a vent port or the like 50. The source of compressed gas can be a small electrically powered air compressor, with a small air tank. The compressor and tank size and volume can be selected to compensate for the projected or known traffic through the door.

The valve 46 may be either solenoid actuated or manually actuated but is preferably solenoid actuated for remote actuation. The valve is provided with variable timer means 52 for adjusting the rate of movement of the valve from the open or actuating to the vent position. The valve is normally biased to the vent position but upon being actuated shifts to the opening position for powering the motor 32.

The variable timer may take any suitable form such as a variably adjustable dashpot or the like which controls or delays the venting of the valve. This holds the door at the open position for the selected time. Thus, with this arrangement the door can be opened to the open position and remain in the fully opened position for various selected periods of time from zero to substantially any selected time desired.

The valve 46 can be actuated by suitable means such as an actuator 54, which may be any suitable conventional actuator which directs an electrical signal by way of suitable conductor means 56 to the valve 46. The actuator 54 may be a simple push button switch closing an electrical contact and thereby electrical circuit for activating the valve 46.

Conventional mat actuators are also possible. Position and movement sensing devices can also be utilized as well as remote radio actuators.

The system is designed to be particularly suitable for use by the handicapped either in wheel chairs or on crutches or the like. The door is simply opened to the open position for a time sufficient to permit a person to pass therethrough. The system opens the door mechanically with very little effort on the part of the operator. The actuator can be adapted for any suitable various modes of actuation and can be suitably located for ease and convenience of actuation by persons in various positions.

The present system also permits the door to be used in a conventional fashion without hindrance from the opening system. With the one way connecting linkage as preferred the door is simply pushed or pulled manually to the open position without any interference whatsoever from the actuating linkage. The door opens and closes in the conventional manner. Thus, the door opening system of the present invention is supplemental to the conventional door, permitting the door to be optionally used either manually or with the mechanical actuating system in accordance with the invention. The system can be easily applied to a conventional door without alteration of the door.

An additional advantage of the system is that a door or the control system can be keyed or set up to be operated in a conventional manner by the handicapped. In other words, certain installations can be set up to be operated with special keys that are available only to the handicapped. In this manner the power system can be available only to those who need it.

The system can also be set up to operate in conjunction with a lock so that the actuator unlocks the door before activating the power opening system.

Turning to FIG. 6 an alternate embodiment of the invention is illustrated wherein identical elements are identified by the same reference numerals. In this embodiment a door and linkage set up as in the previous embodiment is provided with an actuating cylinder 60 substantially like that as in the previous embodiment. In this arrangement the cylinder includes a bracket 62 connected for example at the forward end of the cylinder and pivotly mounted on the pivot arm 28 of the pivot bracket by pivot pin 30. Cylinder 60 includes a piston rod 66 that extends forward therefrom and includes an L bracket or arm 68 which extends slightly forward and at right angles to the rod over to connection to the push arm 24 and pivot pin 70. The length of the arm 68 extending over from the push rod 66 to the arm 24 is less than the distance outward from the arm 24 to the pivot pin 30, to which the cylinder is pivoted to the bracket 20. With this arrangement the cylinder and actuating rod extends at a slight angle to the actuating arm 24 but an appearance of extending somewhat parallel thereto. This angle can vary from about 2 to 7 degrees and is necessary for the cylinder to get sufficient leverage in order to push the door to the outward position. Similarly the pivot pins 22 and 30 are spaced sufficiently far apart as viewed in FIGS. 7 and 9 for example, such that as viewed in FIG. 9 the cylinder extends and maintains an angle with respect to the actuating arm 24 as it swings with the door to the open position. It should also be noted that the pivot pin 22 is disposed somewhat forward of the hinge pin 14 for the door 12 and on the opposite side of the door from the hinge pin. In addition, as previously explained the actuator can be used simply to open the door or can be by-passed simply by opening the door in the conventional manner without the necessity for activating the power system.

Thus, with this arrangement the protruding cylinder is eliminated and the cylinder and actuating mechanism lies closely parallel to the door when the door is in the closed position and is parallel to the door when the door is in the opened position. With this arrangement only a slight protrusion of the cylinder exists when the door is in the opened position as will be apparent from FIG. 8 (depending on pivot pin location along the cylinder). This arrangement can provide for encompassing or enclosing the cylinder and actuating arm with a cover if desired.

While the present invention has been illustrated by means of specific embodiments it is to be understood that numerous changes and modifications may be made therein without departing from the spirit and scope of the invention as defined in the pending claims.

Having described my invention, I now claim:

1. A fluid powered door opening system for a door moveable between an open position and a closed position, the combination comprising:

a mounting bracket for mounting in a fixed position adjacent a door;

a linear fluid motor pivotally mounted on said bracket;

an arm pivotally mounted on said bracket for extending parallel to the face of a door and connected to said fluid motor for unidirectional engagement with and application of force to the face of a door for moving the door in a direction away from said fluid motor to an open position;

a source of pressurized fluid for powering said motor; and a control system for selectively communicating said pressurized fluid to said fluid motor for operation thereof for moving a door to the open position.

2. The door opening system of claim 1 wherein said arm is pivotally mounted at one end for movement about an axis parallel to the axis of the door; and a roller mounted on the other end of the arm for engagement with said door.

3. The door opening system of claim 2 wherein said fluid is a pressurized gas.

4. The door opening system of claim 3 wherein said control system comprises;

a solenoid valve for selectively directing pressurized gas to said motor and for automatically venting said gas from said motor; and a remotely positioned actuator for actuating said valve.

5. The door opening system of claim 4 wherein said control system includes variable timing means for adjusting the duration of said valve opening.

6. The door opening system of claim 4 in combination with a door closer for closing said door when released by said opener.

7. The door opening system of claim 6 in combination with a door mounted for swinging movement from a closed position to an open position about a vertical axis.

8. The door opening system of claim 7 including a bracket mounted above said door, said arm is pivotally mounted on said bracket and extends for pivotal movement with said door to the open position; and said motor having a cylinder pivotally mounted on said bracket and having a piston rod pivotally connected to said arm.

9. The door opening system of claim 2 wherein said arm extends at an angle substantially parallel to the face of the door; and the linear motor is an elongated fluid motor extending with its reciprocating path at an angle of between 2 and 8 degrees with said arm.

10. The door opening system of claim 9 wherein the push rod of said motor is connected to said actuating arm by means of a connecting arm extending at substantially right angles to the push rod.

11. The door opening system of claim 10 wherein said actuating arm and said fluid motor are pivotally mounted on a common bracket and the relative positions of the pivot points are such as to maintain an angle of between 2 and 8 degrees between said arm and said motor in all positions between an opened position and a closed position of said door.

12. The combination of claim 7 wherein the fluid motor is a piston and cylinder combination with said piston pivotally mounted to a bracket adjacent said door and extending substantially parallel to said actuating arm with an angle of between 2 and 8 degrees with respect thereto.

13. The combination of claim 12 wherein the piston and cylinder is connected at the outer end of the piston rod to said actuating arm by means of an L-shaped bracket that has a length less than the distance between the pivot point of the cylinder to said bracket and said lever arm.

14. The combination of claim 8 wherein said arm extends parallel to said door in the opened position and the closed position and said motor and piston rod extending substantially parallel to said arm at an angle of about 5 degrees.

* * * * *